United States Patent [19]

Isaka et al.

[11] 4,456,368

[45] Jun. 26, 1984

[54] IMAGE FORMATION APPARATUS HAVING HIGH FREQUENCY WAVE FIXING MEANS

[75] Inventors: Kazuo Isaka, Kawasaki; Nagao Hosono, Chofu; Tohru Takahashi, Tokyo, all of Japan

[73] Assignee: Canon Kabushiki Kaisha, Tokyo, Japan

[21] Appl. No.: 339,658

[22] Filed: Jan. 15, 1982

[30] Foreign Application Priority Data

Jan. 26, 1981 [JP] Japan ..... 56-9957

[51] Int. Cl.[3] ..... G03G 15/20

[52] U.S. Cl. ..... 355/3 FU; 219/216; 219/388; 219/10.55 R; 219/10.55 F

[58] Field of Search ..... 355/3 FU, 14 FU; 219/216, 388, 10.55 A, 10.55 F, 10.55 R; 34/1

[56] References Cited

U.S. PATENT DOCUMENTS 3,050,606 8/1962 Tibbs ..... 219/10.55 A
3,705,819 12/1972 Heller et al. ..... 34/1 X
3,893,761 7/1975 Buchan et al. ..... 355/3 TR
4,081,213 3/1978 Bar-on et al. ..... 355/3 FU
4,112,285 9/1978 Pan et al. ..... 355/3 FU

FOREIGN PATENT DOCUMENTS 285100 9/1965 Australia ..... 219/10.55 A
1173816 12/1969 United Kingdom ..... 219/10.55 A

OTHER PUBLICATIONS

*Xerox Disclosure Journal* vol. 2, No. 2, Mar./Apr. 1977, p. 49.

*Primary Examiner*—Richard L. Moses
*Attorney, Agent, or Firm*—Fitzpatrick, Cella, Harper & Scinto

[57] ABSTRACT

An image formation apparatus using a high-frequency characterized in that an electric field concentration conductor is provided in conjunction with an opposed conductor. A recording medium is moved through an electric field concentration area formed by these conductors.

27 Claims, 29 Drawing Figures

IMAGE FORMATION APPARATUS HAVING HIGH FREQUENCY WAVE FIXING MEANS

BACKGROUND OF THE INVENTION

1. Field of the Invention

This invention relates to an image formation apparatus such as a copying apparatus or an information recording apparatus for high-frequency-wave-fixing an an unfixed image to thereby form an image.

2. Description of the Prior Art

Fixing devices using high-frequency electromagnetic waves to effect fixation are disclosed in Japanese Patent Publication No. 38171/1974, Japanese Laid-open Patent Application No. 20039/1977 and Japanese Patent Publication No. 10865/1979.

High-frequency wave heating and fixing devices are excellent in eliminating the following disadvantages in the so-called extraneous heating and fixation. That is, they are devices which reduce the wait time until a condition necessary for fixation is reached, eliminate the danger of fire or the like which may occur when a recording medium such as paper stagnates in the fixing area for some reason, and prevent wrinkling of the recording medium and disturbance of the image thereon.

A conventional high-frequency wave heating and fixing device will now be described in greater detail. This device utilizes a hollow microwave guide tube as high-frequency wave generating means, and it is structurally formed as shown in FIG. 1A (prior art) of the accompanying drawings and its cross-section is as shown in FIG. 1B of the accompanying drawings. In FIG. 1, reference numeral 1 designates a microwave oscillator which generates a microwave having a component of electric field in the direction 2 of transmission. A magnetron is used in this microwave oscillator 1. Designated by 3 is a hollow waveguide tube having a rectangular shape through which microwaves are transmitted in the direction of arrow 2. The waveguide tube 3 is provided in parallel to a recording medium 7. Slits 4 are provided in that surface of the waveguide tube with respect to which the surface of the recording medium 7 opposite to the surface bearing a toner image 6 slides. The microwave emitted outwardly through these slits 4 and applied to the toner and recording medium 7 contributes to fixation. (The fixing phenomenon occurs due chiefly to the self-heating and melting resulting from the absorption of high-frequency electromagnetic wave by the toner.) Reference numeral 5 denotes a cooling device provided perpendicularly to the waveguide tube 3 with the waveguide tube interposed between the cooling device and the microwave oscillator 1 to extinguish the generated microwave energy.

However, in the fixing device of the type in which, as described above, slits are formed in a surface of the microwave guide tube to allow leakage of microwave, the size of the slits must be determined such that an area necessary for a predetermined amount of microwave leakage is secured. Therefore, the output of the microwave generator such as a magnetron must be increased to secure an appropriate microwave energy per unit area and this has led to the bulkiness and increased cost of the device. Also, the utilization efficiency of microwave device has been low and accordingly, the fixing efficiency has not been high.

SUMMARY OF THE INVENTION

It is an object of the present invention to provide a novel image recording apparatus which can overcome the above-noted inconveniences.

It is another object of the present invention to provide an image recording apparatus which can improve the utilization efficiency of high-frequency electromagnetic waves such as microwave.

Other objects of the present invention will become apparent from the following detailed description of the invention taken in conjunction with the accompanying drawings.

DESCRIPTION OF THE PREFERRED EMBODIMENTS

Figure 1A:
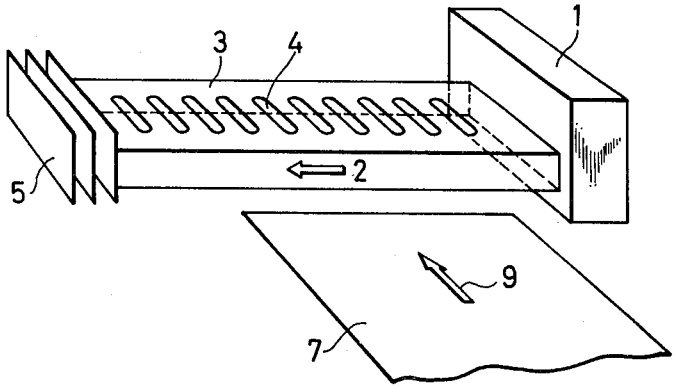
FIG. 1A (PRIOR ART)
FIGS. 1A and 1B illustrate the high-frequency wave fixing device according to the prior art.
Figure 1B:
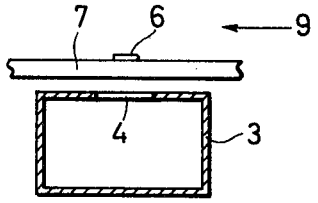
FIG. 1B (PRIOR ART)
Figure 2:
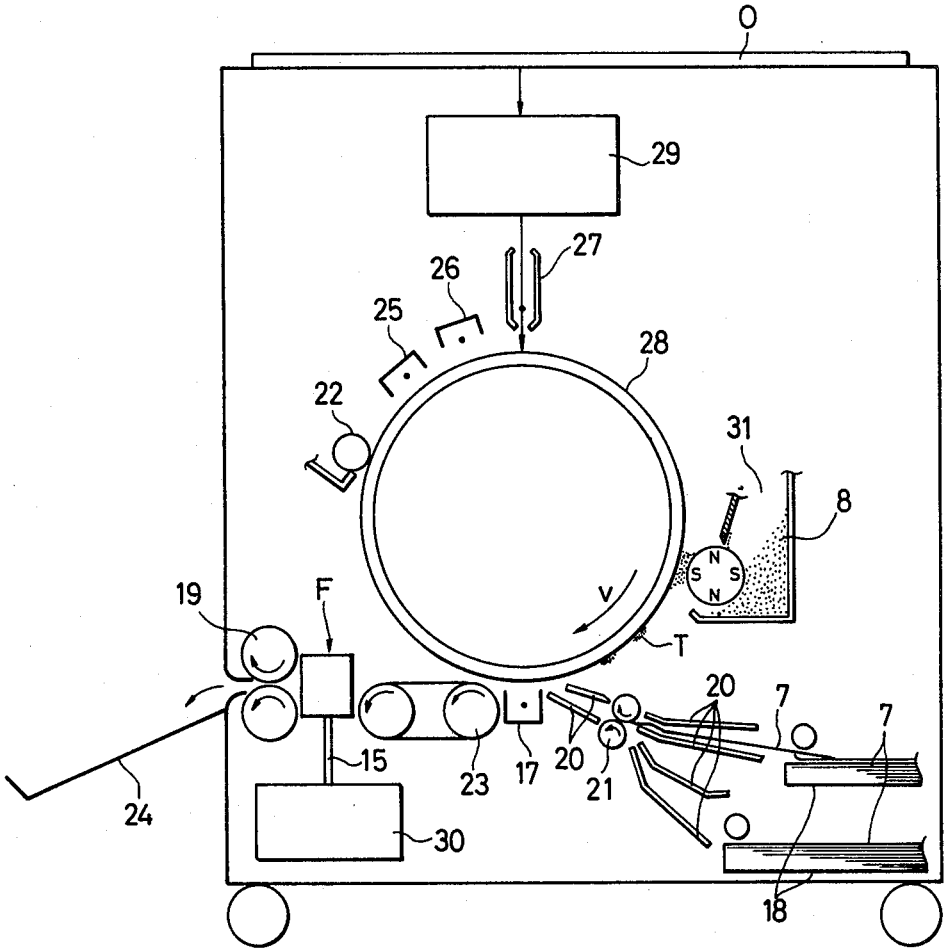
FIG. 2 illustrates the entirety of an embodiment of the present invention.

An embodiment of the present invention will hereinafter be described with reference to FIG. 2. A photosensitive drum 28 having a photosensitive layer on its surface as is well known is rotated at a velocity v in the direction indicated by an arrow by the drive force of a drive source (not shown) in response to a copy signal and pre-discharged by a predischarger 25. Subsequently, the photosensitive drum 28 is charged by a primary charger 26, and then subjected to secondary discharging by a secondary charger 27. The image of an original O is scanned by an optical device 29 including an optical member and an optical member moving means (or alternatively the optical device is fixed and the original O or an original carriage (not shown) is moved), whereby the photosensitive drum 28 is exposed to the image of the original at a desired magnification (one-to-one magnification, reduction or enlargement). The photosensitive drum is then subjected to whole surface exposure, whereby an electrostatic latent image is formed on the drum 28. This latent image is developed into a visible image T by developer 9 in a developing device 31, and the visible image is rotated with the drum 28 to come to an image transfer charger 17.

A recording medium 7 is moved from a cassette 18 along a guide member 20 and conveyed toward the drum 28 to receive the visible image T while being imparted a timing by register rollers 21. Subsequently, the recording medium 7 is charged from the back side thereof to a polarity opposite to that of the visible image T by the image transfer charger 17, whereby the visible image T is transferred onto the recording medium 7. Thereafter, the surface of the photosensitive drum 28 is cleaned by a cleaning roller 22, thus being made ready for another cycle of copying.

On the other hand, the recording medium 7 positively bearing the visible image thereon is separated from the photosensitive drum 28 by a conveyor which serves also as a one-side separator for assisting the separation of the recording medium from the photosensitive drum 28, and is conveyed to a fixing station F near the photosensitive drum 28.

The construction of the fixing station F will later be described fully with reference to FIG. 3 and other figures. The recording medium 7 passes through an electric field concentration area in which microwave concentrates, whereby the visible image T is dielectrically heated and fixed on the recording medium by microwave radiation without leaving any unfixed portion. The microwave radiation is generated by a microwave generating means 30 and supplied to the fixing station by a coaxial cable 15.

The developer (or toner) 9 constituting the visible image T uses, as its main component, a dielectric substance, an electrically conductive substance or a magnetic substance, and these substances produce heat due to eddy current loss, dielectric loss, hysteresis loss, residual magnetism loss or the like by a certain frequency area.

The recording medium 7 having the image thus fixed thereon is discharged onto a tray 24 provided outwardly of the fixing station F and the entire image formation apparatus by a discharge station having discharge rollers 19.

Figure 3:
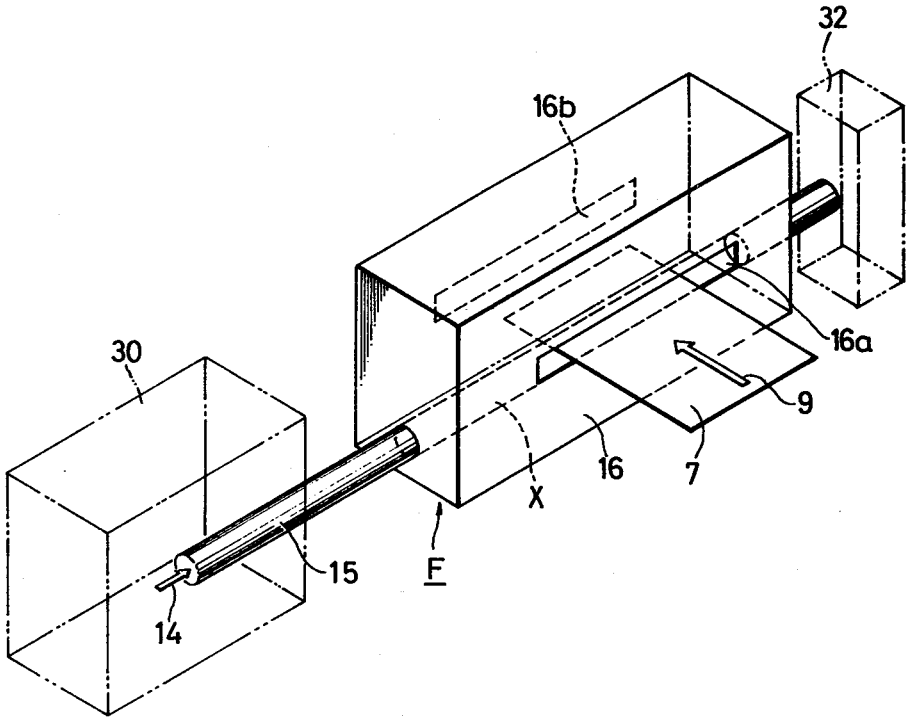
FIG. 3 illustrates essential portions of an embodiment of the present invention.

FIG. 3 is a perspective view showing the construction of an example of the fixing station F according to the present invention which uses high-frequency electromagnetic waves such as microwave. The microwave generated by the microwave generating means 30, for example, an oscillator, is propagated in the direction of arrow 14 by the coaxial cable 15 and transmitted to high-frequency wave applying means X to be described. The toner image on the recording medium 7 moved in the direction of arrow 9 is dielectrically heated and fixed by an electromagnetic field obtained from the microwave applying means. A shield 16 is provided to prevent leakage of the microwave toward the outside of the fixing device, and this shield 16 has slit openings 16*a* and 16*b* of narrow width (through which a recording medium of maximum size can pass) which provide an inlet port and outlet port for the recording medium.

The recording medium 7 may be conveyed in sliding contact with or in proximity to the microwave applying means X and, to improve the conveyance property, for example, a thin synthetic resin film or the like may be disposed in intimate contact with or in proximity to the microwave applying means X, or alternatively a belt-like configuration may be employed so that the recording medium may be moved on this film. Designated by 32 is means for preventing the microwave from being reflected and flowing back to the oscillator after having been transmitted in the direction of arrow 14. For example, the means 32 may have an isolator inserted therein, or may be provided with an absorbing member or a non-reflecting termination at the end portion thereof.

Description will now be made of an example of the microwave applying means X which can fix the width of a recording medium of maximum size with respect to the direction of conveyance.

Figure 4:
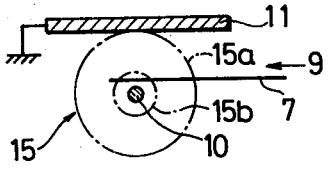
FIGS. 4, 5, 6A, 6B, 7A, 7B, 7C, 7D, 7E, 8A, 8B, 8C, 8D, 9A, 9B, 9C, 9D, 9E, 10A, 10B, 11A, 11B, 12A, 12B and 12C illustrate essential portions of various embodiments of the present invention.

In FIG. 4, reference numeral 10 designates an electric field concentration conductor connected to the central conductor 15*b* of the coaxial cable 15, and reference numeral 11 denotes an opposed conductor which is connected to the external conductor 15*a* of the coaxial cable 15 and is electrically grounded.

The recording medium 7 is moved in the direction of arrow 9 and, when it passes through the vicinity of the electric field concentration conductor 10 in the clearance between the conductors 10 and 11, the visible image on the recording medium is fixed on the recording medium by the electric field of the microwave produced by the conductors 10 and 11.

The electric field concentration conductor 10 is of a width smaller than the width of the cross-section of the opposed conductor 11 with respect to the direction of conveyance of the recording medium 7 (hereinafter referred to as with respect to the cross-section), and has a circular cross-sectional shape. Such a size relation may be established in at least the recording medium passage area of the opposed region of the conductors 10 and 11, and the conductors 10 and 11 are provided in said size relation with the width area perpendicular with respect at least to the direction of conveyance of a recording medium of maximum size.

Figure 5:
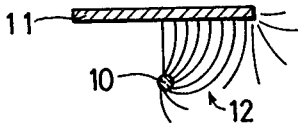

FIG. 5 schematically depicts the manner of distribution of the electric field 12 in the neighborhood of the conductors 10 and 11 as shown in FIG. 4. The electric field 12 exists densely in the vicinity of the electric field concentration conductor 10 and therefore, the toner on the recording medium is efficiently dielectrically heated in the vicinity of the electric field concentration conductor 10.

The toner is subjected to polarization in the microwave field, but an intensity of electric field greater than a predetermined level is required in order that the temperature of the toner itself may change to a condition for fixation (for example, melting). While dielectric heating can be effected for a long time with a small intensity of electric field, it will be more efficient to carry out it for a short time with such a degree of electric field that will not create the discharging which will result in heat diffusion to the air, the recording medium, etc.

If the present invention is used, the electric field may be concentrated in the narrow space within the fixing device and therefore, it becomes possible to obtain effective fixativeness by a small microwave generator output.

Figure 6A:
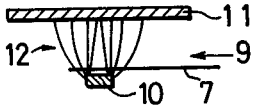
Figure 6B:
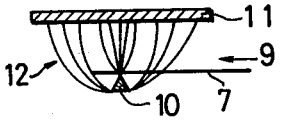

The cross-sectional shape of the electric field concentration conductor may be circular as shown in FIGS. 4 and 5, or may be polygonal such as rectangular or triangular as shown in FIGS. 6A or 6B. In these shapes, the electric field 12 concentrates most densely in the edge portions (or convex portions) of the conductor 10.

Figure 7A:
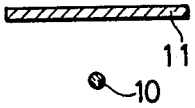
Figure 7B:
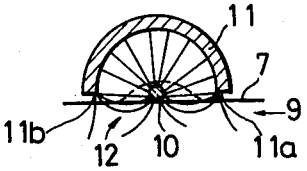
Figure 7C:
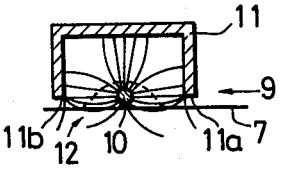

The opposed conductor 11 may be flat as shown in FIG. 7A or in the above-described example, or may be of a concave shape such as a semi-circular cross-sectional shape as shown in FIG. 7B or a U-shaped cross-section as shown in FIG. 7C.

In FIGS. 7B and 7C, the electric field also concentrates in the vicinity of the opposite ends 11*a* and 11*b* of the opposed conductor and therefore, if the recording medium 7 is caused to pass the end 11*a*, the conductor 10 and the end 11*b* in the named order as shown, the toner image will be preheated at the end 11*a* and finally heated at the end 11*b* and thus, very good fixation will become possible. Regular heating is effected in the neighborhood of the conductor 10. The recording medium may pass along the route indicated by broken line, namely, the clearance between the conductors 10 and 11.

Figure 7D:
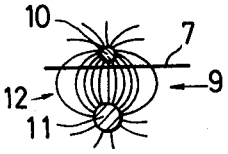

In the above-described embodiment, a case where the width of the conductor 10 (with respect to the direction of conveyance of the recording medium 7) is small as compared with that of the conductor 11 has been shown, whereas in FIG. 7D, both the conductors 10 and 11 may be thin electric field concentration conductors. However, it will be more advantageous that the diameter of the conductor 10 is made smaller than the diameter of the conductor 11 and the recording medium 7 is conveyed on the conductor 10 side.

Figure 7E:
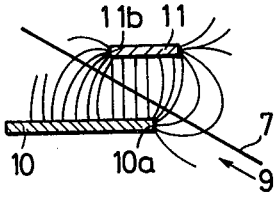

In the embodiment of FIG. 7E, both conductors 10 and 11 are made relatively great in width and are offset with respect to each other to cause the electric field to concentrate in the edge 10*a* of the conductor 10 and the edge 11*b* of the conductor 11. The recording medium 7 is caused to pass near these edges 10*a* and 11*b* in succession and the toner is heated and fixed chiefly at these two locations. Of course, the recording medium may be conveyed in parallel proximity to or in contact with one of the conductors 10 and 11.

Describing the construction of this embodiment in detail, the edge 10*a* of the conductor 10 is opposed to the surface of the conductor 11 and the edge 11*b* of the conductor 11 is opposed to the surface of the conductor 10.

Figure 8A:
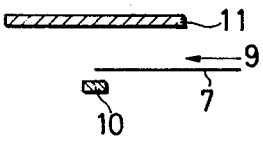
Figure 8B:
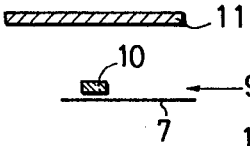
Figure 8C:
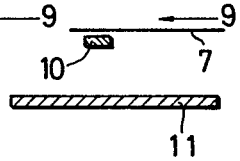
Figure 8D:
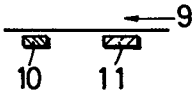

FIGS. 8A, 8B, 8C and 8D show examples of the conveyance path of the recording medium 7. Of course, these figures merely show the positional relation between the recording medium 7 bearing an unfixed visible image thereon and the conductor 10 which is smaller in cross-section than the conductor 11. There will be no difficulty if the conductors 10 and 11 are moved together relative to a stationary recording medium 7. FIG. 8A shows a case where fixation of the recording medium is effected in the clearance between the conductors 10 and 11 and in proximity to or in contact with the conductor 10, and FIGS. 8B, 8C and 8D show cases where the conductors 10 and 11 are disposed on the same side relative to the recording medium and the recording medium is brought into proximity to or into contact with the conductor 10. In the cases of FIGS. 8B, 8C and 8D, as compared with the case of FIG. 8A, the necessity of considering the characteristics of the means for conveyance of the recording medium is eliminated and therefore, it becomes possible to insert an object between the two conductors and thus, the design constraints become less restrictive. The arrangement of FIG. 8A has the advantage that the concentration of the electric field can be effectively utilized, the arrangement of FIG. 8B has the advantage that a conveyor belt can be provided below the recording medium, and the arrangements of FIGS. 8C and 8D have the advantage that the portion above the recording medium is a space and this eliminates the undesirable possibility of the recording medium floating up to touch another member and thereby disturb the visible image on the recording medium. The arrangements of FIGS. 8B, 8C and 8D utilize the phenomenon whereby when an electric field is concentrated, it goes around to the lateral and reverse sides of the conductor 10.

Figure 9A:
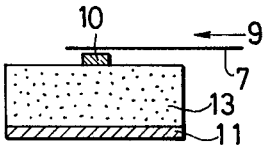
Figure 9B:
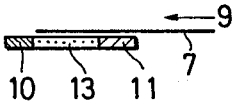
Figure 9C:
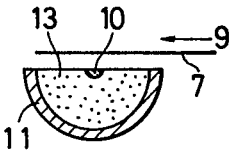
Figure 9D:
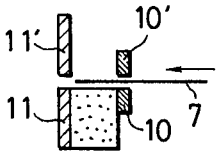
Figure 9E:
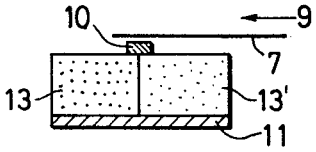

FIGS. 9A, 9B, 9C, 9D and 9E show examples in which a dielectric material 13 is disposed between or in the vicinity of the conductors 10 and 11. The dielectric material 13 may be made of ceramics such as alumina ceramic, steatite ceramic, etc. or muscovite, and in any case, by inserting the dielectric material 13 between the conductors, microwaves can be densely transmitted through a small cross-section as a consequence of this, the high-frequency wave applying means X can be made compact. Also, for example, in the case of FIG. 9A, the conductors 10 and 11 can be patterned as by photoetching with the dielectric material 13 as a substrate and therefore, it becomes possible to make the conductors 10 and 11 thin and the conveyance property of the recording medium becomes very good. The arrangement of FIG. 9B has the advantage that the conductor 11, the dielectric material 13 and the conductor 10 can be formed into a flat unitary member to thereby make the conductor members thinner and make and the microwave (or high-frequency wave) applying means X thinner and more compact. The relative conveyed position of the recording medium in FIG. 9B is in proximity to, or in sliding contact with, a plane formed by the conductors 10, 11 and the dielectric material 13. FIG. 9C shows an example of a typical semicircular cross-section which is a concave cross-section, and in this example, a concentric dielectric material 13 is provided over the outer peripheral surface of a conductor 10 which has a semicircular cross-section, and a concentric semicylindrical conductor 11 is provided over the outer peripheral surface of the dielectric material 13. The recording medium 7 is conveyed in proximity to or in sliding contact with the upper straight surface of the semicircular cross-section. A feature of this arrangement is that it further improves the fixativeness and electric field concentration of the embodiments shown in FIGS. 7B and 7C. In FIG. 9D, a dielectric material is sandwiched between conductors 10 and 11, and conductors 10′ and 11′ are disposed thereabove. The central conductor of a coaxial cable is connected to the conductors 10 and 10′ and an external conductor is connected to the conductors 11 and 11′, and the recording medium 7 is passed through the clearance between the conductors 10 and 10′ and through the clearance between the conductors 11 and 11′, as shown. FIG. 9E shows an arrangement which uses dielectric materials 13 and 13′ of different dielectric constants and in which a conductor 10 is joined to the boundary between the dielectric materials 13 and 13′, so that the concentrated condition of the electric field on the dielectric material 13 side differs from that on the dielectric material 13′ side to thereby improve the fixing efficiency.

Figure 10A:
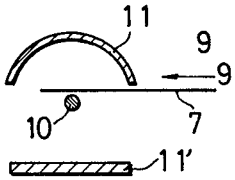
Figure 10B:
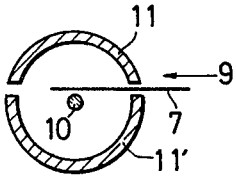

FIGS. 10A and 10B show examples in which opposed conductors 11 (comprising a combination of conductors of semicircular cross-section or planar cross-section) are disposed on the opposite sides of an electric field concentration conductor 10 to improve the fixing efficiency. In FIG. 10B, conductors 11 and 11′ having the configuration of a cylindrical conductor divided into two parts and a conductor 10 of circular cross-section positioned at the center are provided to further improve the concentration of the electric field and the fixativeness.

Figure 11A:
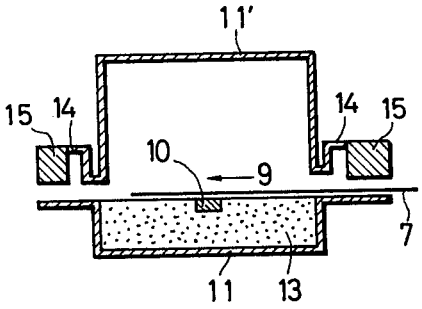

FIG. 11A shows an example in which opposed conductors 11 and 11′ larger in cross-section than a conductor 10 of rectangular cross-section serve also as a shield to prevent microwave leakage. Reference numeral 14 designates chokes provided on the recording medium inlet and outlet sides of the shield of the conductor 11′, and the reference numeral 15 denotes microwave absorbing members provided on the sides of the chokes. These prevent leakage of microwave from the apparatus toward the outside thereof. Reference numeral 13 designates a dielectric material covering the three surfaces of the conductor 10, the three surfaces of the dielectric material of rectangular cross-section being covered by the conductor 11.

Figure 11B:
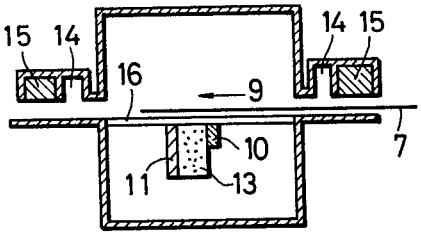

FIG. 11B shows an example similar to the arrangement of FIG. 9D except that the conductors 11′ and 10′ is placed in the shield of FIG. 11A and a sheet of material 16 having a small dielectric loss such as polyethylene or tetrafluoroethylene resin is disposed in proximity to the electric field concentration conductor to improve the conveyance property of the recording medium and obtain a contamination preventing effect (if contaminated, the sheet of material 16 can be readily replaced with another).

Figure 12A:
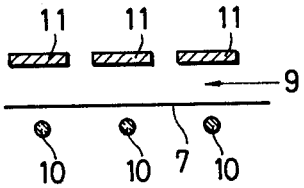
Figure 12B:
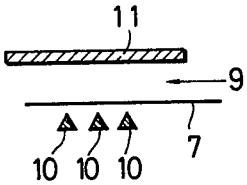
Figure 12C:
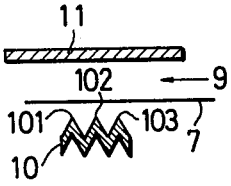

FIG. 12A shows a case where a plurality of sets (in the present example, three sets) of electric field concentration conductors 10 and larger opposed conductors 11 are successively provided in the direction of feed of the recording medium 7, FIG. 12B shows a case where a plurality of smaller electric field concentration conductors 10 are provided relative to a common opposed conductor 11 in the direction 9 of feed of the recording medium, and FIG. 12C shows a case where an electric field concentration conductor 10 smaller relative to an opposed conductor 11 is provided with a plurality of sharp electric field concentration ends 101, 102 and 103.

While various embodiments have so far been described, the present invention is not restricted to these embodiments. A device of the invention may be a combination of these alternate embodiments in order to make the best use of the invention in a particular situation.

In the above-described examples, the conductors 10, 10', 11 and 11' are elongate with respect to a direction perpendicular to the direction 9 of feed of the recording medium.

Also, where a pattern inherent to the electric field is produced along the direction of travel of microwave and this causes non-uniformity of the fixativeness, the high-frequency wave applying means X may be angled with respect to the direction of feed of the recording medium in the plane of conveyance of the recording medium.

If, in this case, the dielectric material 13 is inserted between the conductors as shown in FIGS. 9A, 9B, 9C, 9D and 9E to cause microwave energy to concentrate and reduce the substantial wavelength in the tube, a greater effect will be produced for uniformity of fixation.

The present invention is also applicable to high-frequency wave induction heating and fixation.

As described above with respect to various embodiments, according to the present invention, an unfixed image such as the visible image on the recording medium can be stably fixed at high efficiency and the apparatus can be made compact and inexpensive and high-speed high-frequency wave fixation of high practical value can be realized.

What we claim is:

1. An image formation apparatus including:

means for forming an unfixed image on a recording medium;

fixing means including a first electrically conductive member and a second electrically conductive member having an oposed width smaller than the width of said first electrically conductive member to form an electric field concentration area, wherein said means is for effecting high-frequency-wave-fixing of the unfixed image on the recording medium in an electric field area formed by said first and second electrically conductive members; and means for passing the recording medium, on which the unfixed image is formed, through said electric field concentration area in a close or slidable relationship relative to the second electrically conductive medium, wherein said high-frequency-wave-fixing means as a third electrically conductive member for increasing said electric field area.

2. An image formation apparatus including: means for forming an unfixed image;

fixing means including a first electrically conductive member having a concave conductor, and a second electrically conductive member having an opposed width smaller than the width of said first electrically conductive member to form an electric field concentration area, wherein said means is for effecting high-frequency-wave-fixing of the unfixed image on the recording medium in an electric field area formed by said first and second electrically conductive members; and means for moving the recording medium relative to the electric field concentration area so as to pass the recording medium with the unfixed image thereon through the electric field concentration area.

3. The apparatus according to claim 2, wherein said second electrically conductive member is positioned between the opposite ends of said concave conductor.

4. The apparatus according to claim 3, wherein said moving means moves said recording medium relative to the neighborhoods of the opposite ends of said conductor and said second electrically conductive member.

5. The apparatus according to claim 4, wherein a member having a dielectric constant is interposed between said concave conductor and said second electrically conductive member.

6. An image formation apparatus including:

means for forming an unfixed image;

fixing means including a first electrically conductive member and a second electrically conductive member having an opposed width smaller than the width of said first electrically conductive member to form an electric field concentration area, wherein said means is for effecting high-frequency-wave-fixing of the unfixed image on the recording medium in said electric field area, the high-frequency-wave-fixing means having a dielectric member disposed between the first and second electrically conductive members; and means for moving the recording medium relative to the electric field concentration area so as to pass the recording medium with the unfixed image thereon through the electric field concentration area.

7. The apparatus according to claim 6, wherein said first electrically conductive member is in intimate contact with one surface of said dielectric member.

8. The apparatus according to claim 7, wherein said first electrically conductive member is in intimate contact with the entire surface of said dielectric member.

9. The apparatus according to claim 8, wherein said second electrically conductive member is in intimate contact with another surface of said dielectric member.

10. The apparatus according to claim 9, wherein said high-frequency-wave-fixing means has a high-frequency-wave-applying surface comprising at least a portion of said first and second electrically conductive members and one surface of sid dielectric member, and said moving means moves said recording medium relative to said applying surface.

11. The apparatus according to claim 6, wherein said dielectric member has first and second dielectric materials having different dielectric constants, and said second electrically conductive member is positioned at the juncture of said first and second dielectric materials.

12. An image formation apparatus including:

means for forming an unfixed image on a recording medium;

fixing means including a first electrically conductive member and a second electrically conductive member having an oposed width smaller than the width of said first electrically conductive member to form an electric field concentration area, wherein said means is for effecting high-frequency-wave-fixing of the unfixed image on the recording medium in an electric field area formed by said first and second electrically conductive members; and means for passing the recording medium, on which the unfixed image is formed, through said electric field concentration area in a close or slidable relationship relative to the second electrically conductive medium, wherein the apparatus formed comprises a dielectric member disposed in contact with said first and second electrically conductive members.

13. An image formage apparatus comprising:

means for forming an unfixed image on a recording medium;

fixing means including a first electrically conductive member, a second electrically conductive member disposed closely to the first electrically conductive member, and a dielectric member disposed in contact with said first and second electrically conductive members, wherein said means is for effecting high-frequency-wave-fixing of the unfixed image on the recording medium in an electric field area formed by said first and second electrically conductive members; and means for moving the recording medium relative to the electric field area so as to pass the recording medium having the unfixed image thereon through the electric field area.

14. An image formation apparatus according to claim 13, wherein said first and second electrically conductive members are patterned conductive members formed by photoetching the dielectric member.

15. The apparatus according to claim 13 wherein said dielectric member is a solid member of ceramic or muscovite.

16. The apparatus according to any one of claims 2, 6 and 13 wherein said high frequency wave is a microwave.

17. The apparatus according to claim 16, wherein said first electrically conductive member is used also for microwave leakage shielding.

18. The apparatus according to any one of claims 2, 6 and 13, wherein the apparatus has a resin sheet having a small dielectric loss placed in the electric field area formed by said high-frequency-wave-fixing means.

19. An image formation apparatus according to any one of claims 3, 4, 5, 7 through 11 or 1, 2, 6, 12–15, wherein said second electrically conductive member is a conductor having an edge portion or convex portion where microwave concentrates.

20. An image formation apparatus according to claim 18, wherein said second electrically conductive member is a conductor having an edge portion or convex portion where microwave concentrates.

21. An image formation apparatus according to any one of claims 3 through 5, 7 through 11, or 1, 2, 6, 12–15, wherein said second electrically conductive member is included relative to the direction perpendicular to the feeding direction of the recording medium.

22. An image formation apparatus according to claim 17, wherein said second electrically conductive member is inclined relative to the direction perpendicular to the feeding direction of the recording medium.

23. An image formation apparatus according to claim 18, wherein said second electrically conductive member is inclined relative to the direction perpendicular to the feeding direction of the recording medium.

24. An image formation apparatus according to claim 19, wherein said second electrically conductive member is inclined relative to the direction perpendicular to the feeding direction of the recording medium.

25. An image formation apparatus according to claim 17, wherein said second electrically conductive member is inclined relative to the direction perpendicular to the feeding direction of the recording medium.

26. An image formation apparatus according to claim 18, wherein said second electrically conductive member is inclined relative to the direction perpendicular to the feeding direction of the recording medium.

27. An image formation appratus according to any one of claims 3 through 5, 7 to 11, or 1, 2, 6, 12–15, wherein said relation in cross-sectional sizes of said second electrically conductive member to said first electrically conductive member is satisfied at least in the region where the recording medium passes.

* * * * *

UNITED STATES PATENT AND TRADEMARK OFFICE

CERTIFICATE OF CORRECTION

PATENT NO. : 4,456,368

DATED : June 26, 1984

INVENTOR(S) : KAZUO ISAKA, ET AL.

It is certified that error appears in the above-identified patent and that said Letters Patent is hereby corrected as shown below:

IN THE ABSTRACT

Between lines 1 and 2, insert --wave-fixing device, and being--.

COLUMN 1

Line 9, delete "an" (first occurrence).

COLUMN 3

Line 28, "microwave" (first occurrence) should read --microwaves--.

COLUMN 5

Line 63, after "cross-section: insert --.--. "as" should read --As--.

COLUMN 6

Line 6, delete "and" (second occurrence).

Line 67, "is" should read --are--.

CLAIM 10

Line 5, "sid" should read --said--.

CLAIM 12

Line 6, "oposed" should read --opposed--.

UNITED STATES PATENT AND TRADEMARK OFFICE

CERTIFICATE OF CORRECTION

PATENT NO. : 4,456,368

DATED : June 26, 1984

INVENTOR(S) : KAZUO ISAKA, ET AL.

It is certified that error appears in the above-identified patent and that said Letters Patent is hereby corrected as shown below:

CLAIM 13

Line 1, "formage" should read --formation--.

Signed and Sealed this

*Twenty-sixth* Day of *March 1985*

[SEAL]

*Attest:*

DONALD J. QUIGG

*Attesting Officer* *Acting Commissioner of Patents and Trademarks*